US010605152B2

(12) United States Patent
Lee et al.

(10) Patent No.: US 10,605,152 B2
(45) Date of Patent: Mar. 31, 2020

(54) SEPARATE COOLING SYSTEM FOR VEHICLE

(71) Applicants: Hyundai Motor Company, Seoul (KR); KIA Motors Corporation, Seoul (KR)

(72) Inventors: Hyo Jo Lee, Gyeonggi-do (KR); Woo Yeol Jung, Gyeonggi-do (KR); Tae Man Chung, Gyeonggi-do (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 112 days.

(21) Appl. No.: 16/020,487

(22) Filed: Jun. 27, 2018

(65) Prior Publication Data

US 2019/0186338 A1 Jun. 20, 2019

(30) Foreign Application Priority Data

Dec. 18, 2017 (KR) ..... 10-2017-0174549

(51) Int. Cl.
*F01P 7/16* (2006.01)
*F01P 3/02* (2006.01)
*F01P 7/14* (2006.01)

(52) U.S. Cl.
CPC ..... *F01P 7/165* (2013.01); *F01P 3/02* (2013.01); *F01P 2003/024* (2013.01); *F01P 2007/146* (2013.01)

(58) Field of Classification Search
CPC ..... F01P 7/165; F01P 3/02; F01P 2003/024; F01P 2007/146; F01P 11/16; F01P 7/16; F01P 11/028; F01P 11/0285; F02F 1/40
See application file for complete search history.

(56) References Cited

U.S. PATENT DOCUMENTS 9,115,634 B2 * 8/2015 Triebe ..... F01P 7/161
2007/0186878 A1 * 8/2007 Wantschik ..... F01P 7/165 123/41.29
2009/0114171 A1 * 5/2009 Hayashi ..... F01P 3/02 123/41.44
2010/0288213 A1 * 11/2010 Terada ..... F01P 7/16 123/41.08
2011/0005474 A1 * 1/2011 Carlson ..... F01P 5/12 123/41.1

FOREIGN PATENT DOCUMENTS

JP 10-082320 A 3/1998

* cited by examiner

*Primary Examiner* — Syed O Hasan
(74) *Attorney, Agent, or Firm* — Brinks Gilson & Lione

(57) ABSTRACT

The present disclosure relates to a separate cooling system of a vehicle, including an engine including a cylinder head and a cylinder block transmitting a coolant to the cylinder head, a coolant pump, a plurality of parts disposed on a plurality of coolant lines, an electronic thermostat mounted on the cylinder block so as to selectively transmit the coolant from the cylinder block to the plurality of coolant lines, a cooling coolant temperature sensor measuring a coolant temperature of the cylinder block, a controller controlling an operation of the electronic thermostat depending on a vehicle operation state output signal including the cooling coolant temperature sensor, and a mechanical thermostat disposed at an upstream of the coolant pump so as to selectively block the coolant via a radiator and a reservoir tank among the coolant transmitted from the plurality of coolant line to the coolant pump.

9 Claims, 6 Drawing Sheets

SEPARATE COOLING SYSTEM FOR VEHICLE

CROSS-REFERENCE TO RELATED APPLICATION

This application claims priority to and the benefit of Korean Patent Application No. 10-2017-0174549 filed in the Korean Intellectual Property Office on Dec. 18, 2017, the entire contents of which are incorporated herein by reference.

FIELD

The present disclosure relates to a cooling system for a vehicle.

BACKGROUND

The statements in this section merely provide background information related to the present disclosure and may not constitute prior art.

An electronic thermostat is a technology to control a flow rate by adjusting a switching valve according to a state of an engine, and a partial control of a coolant flow rate is desired for enhancement of fuel consumption.

Particularly, fuel consumption may be modified through a technique separately cooling a cylinder head and a cylinder block, however two or more thermostats are generally desired for this.

That is, a head thermostat of a main thermostat controlling an engine exit coolant temperature and a block thermostat which controls the coolant temperature of the block to separately cool the cylinder head and the cylinder block must be provided.

SUMMARY

The present disclosure provides a separate cooling system for a vehicle realizing the enhancement of the fuel consumption by separately controlling the coolant flow flowing through the cylinder head and the cylinder block.

The present disclosure provides a separate cooling system for a vehicle realizing a flow stop of the cylinder block and a cylinder head/block separate cooling by using an electronic thermostat and executing a degassing only in a case that a mechanical thermostat is opened.

A separate cooling system of a vehicle according to any one form of the present disclosure includes an engine including a cylinder head and a cylinder block transmitting a coolant to the cylinder head; a coolant pump transmitting the coolant to the cylinder block; a plurality of parts disposed on a plurality of coolant lines connected to the cylinder head and exchanging heat with the coolant; an electronic thermostat mounted on the cylinder block so as to selectively transmit the coolant from the cylinder block to the plurality of coolant lines; a cooling coolant temperature sensor measuring a coolant temperature of the cylinder block to output a correspond signal; a controller controlling an operation of the electronic thermostat depending on a vehicle operation state output signal including the cooling coolant temperature sensor; and a mechanical thermostat disposed at an upstream of the coolant pump so as to selectively block the coolant via a radiator and a reservoir tank among the coolant transmitted from the plurality of coolant line to the coolant pump.

The plurality of coolant lines may include a first coolant line connecting the mechanical thermostat via the radiator; a second coolant line branched from the first coolant line and connected to the mechanical thermostat via the reservoir tank; and a bypass coolant line selectively transmitting the coolant to a temperature sensing portion of the mechanical thermostat. The coolant of the first coolant line and the second coolant line may be transmitted to the coolant pump through the mechanical thermostat depending on a temperature of the coolant transmitted from the bypass coolant line.

The plurality of coolant lines may further include a third coolant line via a high pressure (HP) exhaust gas recirculation (EGR) cooler.

The plurality of coolant lines may further include a fourth coolant line via a heater core.

The mechanical thermostat may include a thermostat housing including a first port in communication with the bypass coolant line, a second port in communication with the first coolant line and the second coolant line, and a third port in communication with the coolant pump; a thermostat body; a first valve mounted on the thermostat body and selectively blocking the first port; and a second valve mounted on the thermostat body and selectively opening the second port.

The plurality of parts may include at least two selected from a group including a heater core, a low pressure (LP) EGR cooler, an EGR valve, a HP EGR cooler, an oil cooler, and an automatic transmission oil warmer.

A separate cooling system for a vehicle according to one form of the present disclosure includes an engine including a cylinder head and a cylinder block transmitting a coolant to the cylinder head; a coolant pump transmitting the coolant to the cylinder block; a mechanical thermostat disposed at an upstream of the coolant pump; a first coolant line connected to the mechanical thermostat via a radiator; a second coolant line branched from the first coolant line and connected to the mechanical thermostat via a reservoir tank; a bypass coolant line selectively transmitting the coolant to a temperature sensing portion of the mechanical thermostat; a third coolant line via a HP EGR cooler; a fourth coolant line via a heater core; an electronic thermostat mounted on the cylinder block so as to selectively transmit the coolant from the cylinder block to the plurality of coolant lines; a cooling coolant temperature sensor measuring a coolant temperature of the cylinder block to output a corresponding signal; and a controller controlling an operation of the electronic thermostat depending on an output signal of the cooling coolant temperature sensor, wherein the mechanical thermostat transmits the coolant via the reservoir tank and the radiator to the coolant pump depending on a coolant temperature of the bypass coolant line.

The mechanical thermostat may include a thermostat housing including a first port in communication with the bypass coolant line, a second port in communication with the first coolant line and the second coolant line, and a third port in communication with the coolant pump; a thermostat body; a first valve mounted on the thermostat body and selectively blocking the first port; and a second valve mounted on the thermostat body and selectively opening the second port.

The thermostat housing may include a fourth port in communication with the third coolant line and a fifth port in communication with the fourth coolant line.

If an output signal of the cooling coolant temperature sensor exceeds a predetermined reference temperature, the controller controls an operation of the electronic thermostat to exhaust the coolant of the cylinder block.

According to the separate cooling system of the vehicle according to one form of the present disclosure, the flow stop of the cylinder block and the cylinder head/block separate cooling may be realized by using the electronic thermostat.

According to the separate cooling system of the vehicle according to one form of the present disclosure, the degassing may be executed only in the case that the mechanical thermostat is opened.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
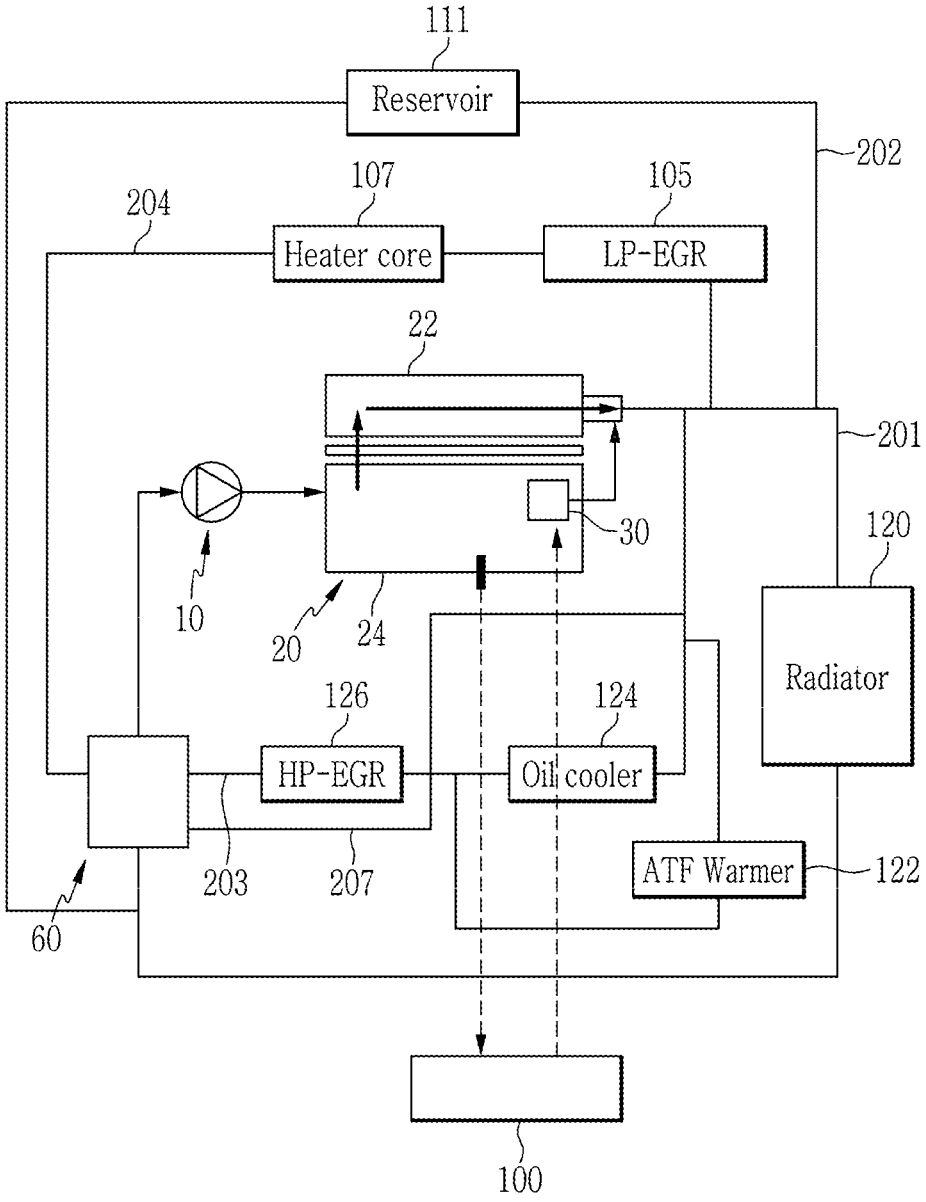
FIG. 1 is a schematic diagram of a separate cooling system for a vehicle according to one form of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

As those skilled in the art would realize, the described forms may be modified in various different ways, all without departing from the spirit or scope of the present disclosure.

Like reference numerals designate like elements throughout the specification.

In the specification, unless explicitly described to the contrary, the word "comprise" and variations such as "comprises" or "comprising", will be understood to imply the inclusion of stated elements but not the exclusion of any other elements.

One form of the present disclosure will hereinafter be described in detail with reference to the accompanying drawings.

FIG. 1 is a schematic diagram of a separate cooling system of a vehicle according to one form of the present disclosure.

Referring to FIG. 1, a separate cooling system for a vehicle according to one form of the present disclosure includes a coolant pump 10, an engine 20 including a cylinder head 22 and a cylinder block 24, a plurality of parts disposed on a plurality of coolant lines connected to the cylinder head 22 and exchanging heat with the coolant, an electronic thermostat 30 mounted on the cylinder block 24 to selectively transmit the coolant from the cylinder block 24 to the plurality of coolant lines, a cooling coolant temperature sensor measuring a coolant temperature of the cylinder block 24 to output a corresponding signal, a controller 100 controlling an operation of the electronic thermostat 30 according to a vehicle operation state output signal included in the cooling coolant temperature sensor 28, and a mechanical thermostat 60 disposed at an upstream of the coolant pump 10 to selectively block the coolant via a radiator 120 and a reservoir tank 111 among the coolant transmitted from the plurality of coolant lines to the coolant pump 10.

The vehicle operation state output signal may further include, for example, an output signal of an outdoor temperature sensor, an output signal of an accelerator opening sensor, etc.

The electronic thermostat 30 includes an electric heater, since it is a matter obvious to ordinary technicians in the technical field as a configuration heating a wax by using the electric heater to control an opening, a description of a concrete configuration and operation, etc. thereof is omitted.

The coolant pump 10 may be a coolant pump of various shapes such as a mechanical coolant pump, etc.

The coolant pump 10 transmits the coolant to the cylinder block 24, as the cylinder block 24 and the cylinder head 22 communicate with each other, the coolant transmitted to the cylinder block 24 is transmitted to the cylinder head 22.

The plurality of coolant lines includes a first coolant line 201 connecting the mechanical thermostat 60 via the radiator 120, a second coolant line 202 branched from the first coolant line 201 and connected to the mechanical thermostat 60 via the reservoir tank 111, and a bypass coolant line 207 selectively transmitting the coolant to the temperature sensing portion 64 of the mechanical thermostat 60.

The coolant of the first coolant line 201 and the second coolant line 202 is transmitted to the coolant pump 10 through the mechanical thermostat 60 depending on the temperature of the coolant transmitted from the bypass coolant line 207.

The plurality of coolant lines may further include a third coolant line 203 via a HP EGR cooler 126 and may further include a fourth coolant line 204 via a heater core 107.

The plurality of parts may include at least two among a group including the heater core 107, a LP EGR cooler 105, an EGR valve 109, the HP EGR cooler 126, an oil cooler 124, an automatic transmission oil warmer 122.

Figure 2:
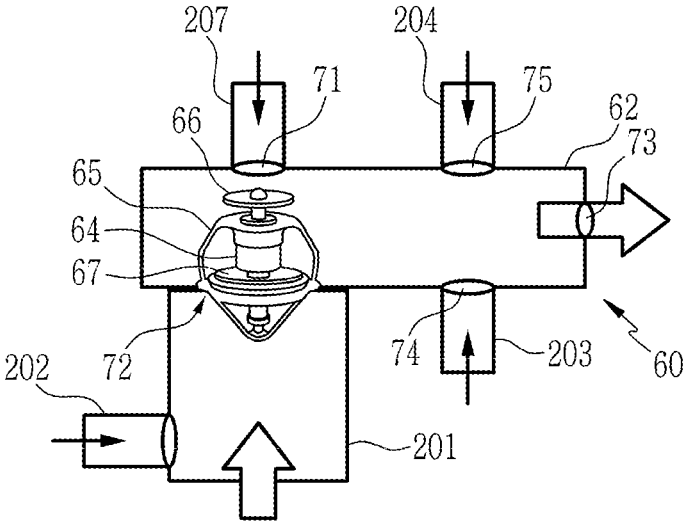
FIG. 2 and FIG. 3 are views showing a mechanical thermostat according to one form of the present disclosure.
Figure 3:
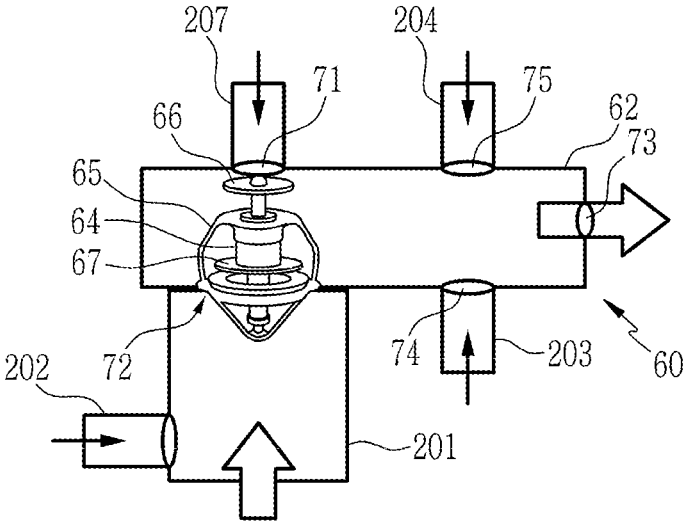

FIG. 2 and FIG. 3 are views showing a mechanical thermostat according to one form of the present disclosure.

Referring to FIG. 2 and FIG. 3, the mechanical thermostat 60 may include a thermostat housing 62 in which a first port 71 communicating with the bypass coolant line 207, a second port 72 communicating with the first coolant line 201 and the second coolant line 202, and a third port 73 communicating with the coolant pump 10, a thermostat body 65, a first valve 66 mounted on the thermostat body 65 and selectively blocking the first port 71, and a second valve 67 mounted on the thermostat body 65 and selectively opening the second port 72.

The was the temperature sensing portion 64 is filled with the wax and the like, and the first valve 66 and the second valve 67 are closed and opened depending on a heat transmission into the temperature sensing portion 64.

As shown in FIG. 2, when the temperature of the coolant transmitted through the bypass line 207 is less than a low temperature, for example, 80° C., the mechanical thermostat 60 is not opened such that the coolant of the first coolant line 201 and the second coolant line 202 does not flow.

As shown in FIG. 3, when the temperature of the coolant transmitted through the bypass line 207 is beyond a high temperature, for example 80° C., while the heat is transmitted to the temperature sensing portion 64, for example, while the wax is expanded, the first valve 66 blocks the first port 71, and the second valve 67 blocking the second port 72 is opened, the coolant of the first coolant line 201 and the second coolant line 202 flows.

That is, while the coolant flows through the first coolant line 201 to be cooled and flows through the second coolant line 202, a degassing step is executed. Accordingly, as the degassing step is executed only when the coolant has a relatively high temperature, the bubbles in the cooling system are removed and the coolant having a relatively high temperature is circulated, thereby improving the fuel consumption.

Figure 4:
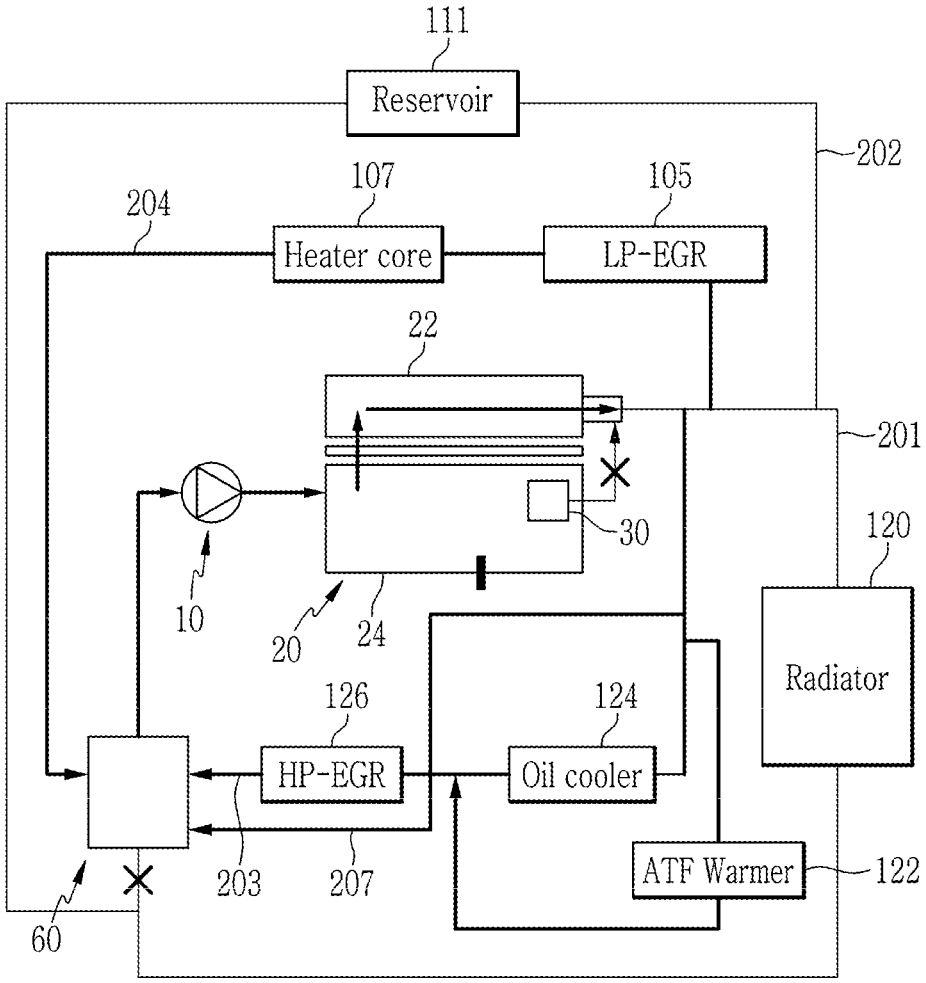
FIG. 4 to FIG. 6 are views showing an operation move of a separate cooling system for a vehicle according to one form of the present disclosure.
Figure 5:
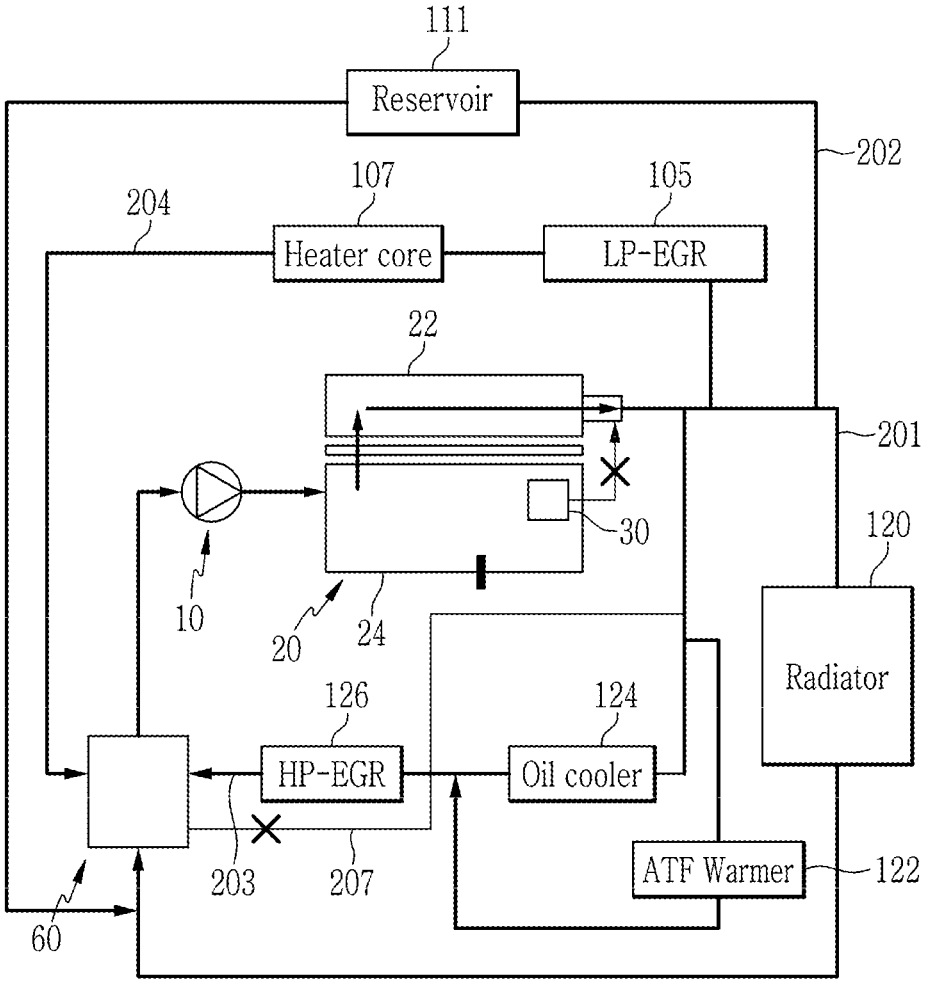
Figure 6:
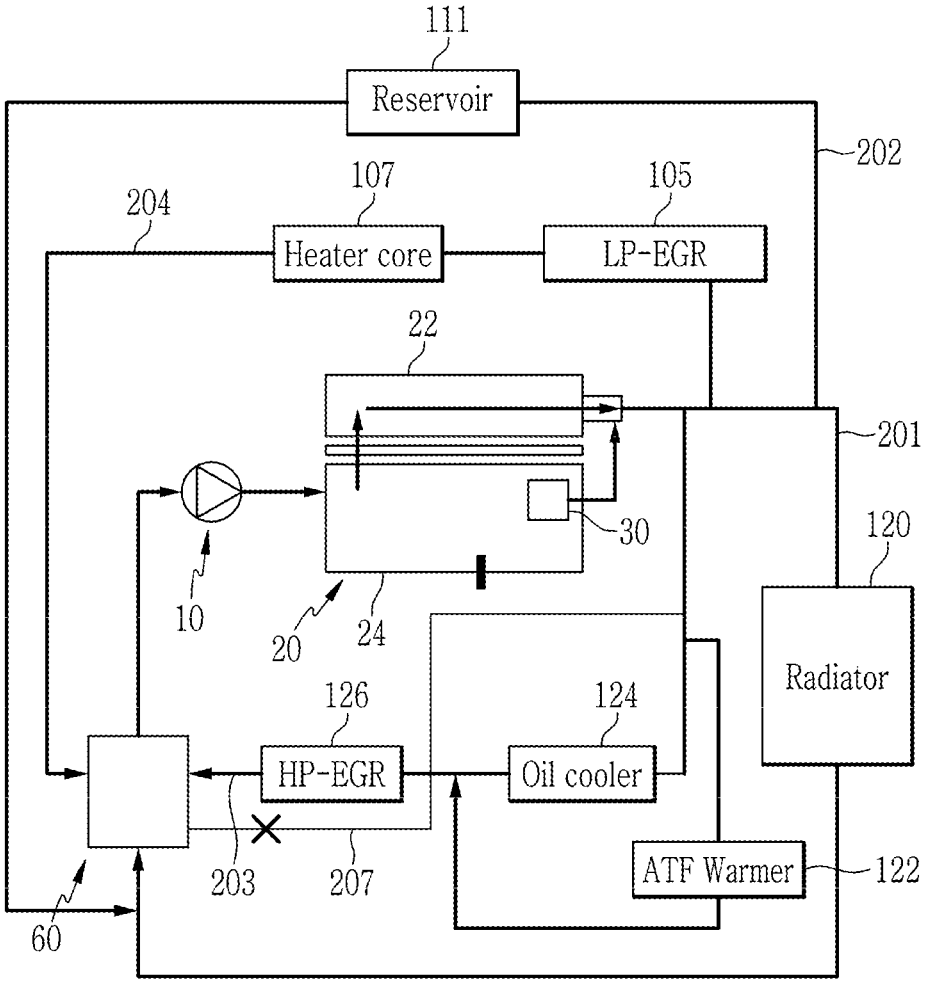

FIG. 4 to FIG. 6 are views showing an operation mode of a separate cooling system for a vehicle according to one variation of the present disclosure.

FIG. 4 is a view showing a cooling mode and a warming mode of the separate cooling system for the vehicle according to one variation of the present disclosure.

In the cooling and warming mode, the electronic thermostat 30 is not operated, such that the coolant flow of the cylinder block 24 is blocked. Accordingly, a rapid warmup is possible, thereby reducing friction and improving the fuel consumption.

FIG. 5 is a view showing a heating mode of the separate cooling system for the vehicle according to one form of the present disclosure.

In the heating mode in a state exceeding about 80° C., if the temperature of the coolant through the bypass line 207 exceeds the high temperature, for example, 80° C., while the heat is transmitted to the temperature sensing portion, for example, the wax is expanded, the first valve 66 blocks the first port 71, and the second valve 67 blocking the second port 72 is opened, the coolant of the first coolant line 201 and the second coolant line 202 flows.

Accordingly, the heat of the engine may be exhausted through the radiator 120 and the degassing may be executed through the reservoir tank 111.

FIG. 6 is a view showing a high temperature heating mode of the separate cooling system of the vehicle according to one form of the present disclosure.

In the high temperature heating mode, when the coolant temperature of the cylinder block 24 is about 105° C., the controller 100 operates the electronic thermostat 30 so that the coolant of the cylinder block 24 is exhausted through the plurality of coolant lines.

In this state, since the mechanical thermostat 60 and the electronic thermostat 30 are all opened, the cooling of the engine and degassing are possible.

According to the separate cooling system of the vehicle according to one form of the present disclosure, the region where the coolant flow within the cylinder block is stopped may be widened such that the fuel consumption may be improved, and the coolant flows into the cylinder block in the high temperature heating condition, thereby improving the cooling performance.

The description is provided in connection with practical variations. It is to be understood that the disclosure is not limited to only what is illustrated and described. On the contrary, it is intended to cover various modifications and equivalent arrangements included within the spirit and scope of the appended claims.

What is claimed is:

1. A separate cooling system of a vehicle comprising: an engine including a cylinder head and a cylinder block transmitting a coolant to the cylinder head; a coolant pump configured for transmitting the coolant to the cylinder block; a plurality of parts disposed on a plurality of coolant lines connected to the cylinder head and configured for exchanging heat with the coolant; an electronic thermostat mounted on the cylinder block so as to selectively transmit the coolant from the cylinder block to the plurality of coolant lines; a cooling coolant temperature sensor measuring a coolant temperature of the cylinder block to output a corresponding signal; a controller controlling an operation of the electronic thermostat depending on a vehicle operation state output signal including the cooling coolant temperature sensor; a mechanical thermostat disposed upstream of the coolant pump and configured to selectively block the coolant via a radiator and a reservoir tank among the coolant transmitted from the plurality of coolant lines to the coolant pump, wherein: the plurality of coolant lines includes a first coolant line connecting the mechanical thermostat via the radiator; a second coolant line branched from the first coolant line and connected to the mechanical thermostat via the reservoir tank; and a bypass coolant line selectively transmitting the coolant to a temperature sensing portion of the mechanical thermostat, the coolant of the first coolant line and the second coolant line being transmitted to the coolant pump through the mechanical thermostat depending on a temperature of the coolant transmitted from the bypass coolant line.

2. The separate cooling system for the vehicle of claim 1, wherein:

the plurality of coolant lines further include a third coolant line via a high pressure exhaust gas recirculation cooler.

3. The separate cooling system for the vehicle of claim 2, wherein:

the plurality of coolant lines further includes a fourth coolant line via a heater core.

4. The separate cooling system for the vehicle of claim 1, wherein:

the mechanical thermostat includes a thermostat housing including a first port in communication with the bypass coolant line, a second port in communication with the first coolant line and the second coolant line, and a third port in communication with the coolant pump;

a thermostat body;

a first valve mounted on the thermostat body and selectively blocking the first port; and a second valve mounted on the thermostat body and selectively opening the second port.

5. The separate cooling system for the vehicle of claim 1, wherein:

the plurality of parts includes at least two among a group including a heater core, a low pressure exhaust gas recirculation cooler, an exhaust gas recirculation valve, a high pressure exhaust gas recirculation cooler, an oil cooler, and an automatic transmission oil warmer.

6. A separate cooling system for a vehicle comprising:

an engine including a cylinder head and a cylinder block transmitting a coolant to the cylinder head;

a coolant pump configured for transmitting the coolant to the cylinder block;

a mechanical thermostat disposed upstream of the coolant pump;

a first coolant line connected to the mechanical thermostat via a radiator;

a second coolant line branched from the first coolant line and connected to the mechanical thermostat via a reservoir tank;

a bypass coolant line configured for selectively transmitting the coolant to a temperature sensing portion of the mechanical thermostat;

a third coolant line via a high pressure exhaust gas recirculation cooler;

a fourth coolant line via a heater core;

an electronic thermostat mounted on the cylinder block so as to selectively transmit the coolant from the cylinder block to the plurality of coolant lines;

a cooling coolant temperature sensor configured for measuring a coolant temperature of the cylinder block to output a corresponding signal; and a controller configured for controlling an operation of the electronic thermostat depending on an output signal of the cooling coolant temperature sensor, wherein the mechanical thermostat transmits the coolant via the reservoir tank and the radiator to the coolant pump depending on a coolant temperature of the bypass coolant line.

7. The separate cooling system for the vehicle of claim 6, wherein:

the mechanical thermostat includes a thermostat housing including a first port in communication with the bypass coolant line, a second port in communication with the first coolant line and the second coolant line, and a third port in communication with the coolant pump;

a thermostat body;

a first valve mounted on the thermostat body and configured for selectively blocking the first port; and a second valve mounted on the thermostat body and configured for selectively opening the second port.

8. The separate cooling system for the vehicle of claim 6, wherein:

the thermostat housing includes a fourth port in communication with the third coolant line and a fifth port in communication with the fourth coolant line.

9. The separate cooling system for the vehicle of claim 6, wherein:

if an output signal of the cooling coolant temperature sensor exceeds a predetermined reference temperature, the controller controls an operation of the electronic thermostat to exhaust the coolant of the cylinder block.

* * * * *